US008298987B2

(12) United States Patent
Etoh et al.

(10) Patent No.: US 8,298,987 B2
(45) Date of Patent: Oct. 30, 2012

(54) HEAT-SENSITIVE RECORDING MATERIALS

(75) Inventors: Akinori Etoh, Ichihara (JP); Keiichi Taki, Funabashi (JP); Shinjirou Sakurai, Kamakura (JP); Tomokazu Ishizuka, Ichihara (JP); Yasuo Okada, Ichihara (JP)

(73) Assignee: Mitsui Chemicals, Inc., Tokyo (JP)

( * ) Notice: Subject to any disclaimer, the term of this patent is extended or adjusted under 35 U.S.C. 154(b) by 984 days.

(21) Appl. No.: 12/083,974

(22) PCT Filed: Oct. 24, 2006

(86) PCT No.: PCT/JP2006/321172

§ 371 (c)(1),
(2), (4) Date: Apr. 23, 2008

(87) PCT Pub. No.: WO2007/049621

PCT Pub. Date: May 3, 2007

(65) Prior Publication Data

US 2009/0258784 A1 Oct. 15, 2009

(30) Foreign Application Priority Data

Oct. 24, 2005 (JP) ..... 2005-308341

(51) Int. Cl.
*B41M 5/30* (2006.01)
*B41M 5/42* (2006.01)

(52) U.S. Cl. ..... 503/226

(58) Field of Classification Search ..... None
See application file for complete search history.

(56) References Cited

U.S. PATENT DOCUMENTS

| | | | |
|---|---|---|---|
| 6,770,430 | B1 | 8/2004 | Kudo |
| 2006/0166821 | A1 | 7/2006 | Sakurai et al. |

FOREIGN PATENT DOCUMENTS

| | | | |
|---|---|---|---|
| CN | 1267689 | A | 9/2000 |
| EP | 1 038 931 | B1 | 8/2005 |
| JP | 62-173284 | A | 7/1987 |
| JP | 04-191088 | | 7/1992 |
| JP | 5-185726 | A | 7/1993 |
| JP | 11-314454 | | 11/1999 |
| JP | 2004-074531 | | 3/2004 |
| WO | WO 2004/016440 | A1 | 2/2004 |

OTHER PUBLICATIONS

Chinese Office Action mailed Jul. 17, 2009, received in corresponding Chinese Application No. 2006800394685.
European Search Report mailing date of Nov. 3, 2009 for European Application No. 06822152.2 (9 pgs).
Communication pursuant to Article 94(3) EPC European Application No. 06 822 152.2 dated Jul. 11, 2012.
A.A. Askadskii, "Computational Materials Science of Polymers", Jan. 2003, Cambridge International Science Publishing Ltd., ISBN: 1-898326-6-22, p. 507.

*Primary Examiner* — Bruce H Hess
(74) *Attorney, Agent, or Firm* — Foley & Lardner LLP

(57) ABSTRACT

A heat-sensitive recording material includes a heat-sensitive recording layer on a support which layer produces a color upon heating, and a protective layer on the heat-sensitive recording layer. The protective layer is obtained from a composition (A) based on an emulsion of a copolymer resin (a). The copolymer resin (a) includes a vinyl monomer component having a carboxyl group, and a vinyl monomer component copolymerizable with the vinyl monomer component. The copolymer resin (a) contains 1 to 10 parts by weight of the vinyl monomer component having a carboxyl group. The copolymer resin has a SP value (solubility parameter) of not less than 9.5 $(cal/cm^3)^{1/2}$ and a glass transition temperature (Tg) of 20 to 130° C. The emulsion of the copolymer resin (a) has a minimum film-forming temperature (MFT) of more than 5° C. The emulsion for heat-sensitive recording material provides high durability, in particular water resistance, anti-blocking properties in water-wetted state and chemical resistance, and has significantly improved storage stability.

8 Claims, No Drawings

HEAT-SENSITIVE RECORDING MATERIALS

TECHNICAL FIELD

The present invention relates to heat-sensitive recording materials. In further detail, the invention relates to heat-sensitive recording materials in which by the use of a specific copolymer resin emulsion, a recording layer of the material and a recorded image show markedly improved durability, in particular antiblocking properties in water-wetted state and chemical resistance.

BACKGROUND ART

General recording materials are composed of a support and a colorless or lightly colored heat-sensitive recording layer which contains an electron donating basic dye and an electron accepting organic or inorganic substance. Such recording materials, in particular heat-sensitive recording paper, are widely used as output sheets for a variety of printers including facsimiles, terminals for industrial measuring instruments, medical terminals, handy terminals, POS systems and ticketing systems.

Because the fields in which the heat-sensitive recording materials are used are wide ranged, the use environments are also diverse. Daily use of such materials has encountered various problems. For example, when water comes in contact with the recording materials, the recording layers can be detached. When a vinyl chloride film or sheet is placed on the recording material, plasticizers contained in the vinyl chloride cause the images to fade or disappear. Further, contact with fats, oils and solvents causes fading or discoloration, or coloration.

Studies have focused on binders and color developing materials in heat-sensitive recording layers to solve the above problems, but none has satisfied water resistance and resistance to chemicals such as plasticizers, oils, fats and solvents. In particular, the applications of the heat-sensitive recording materials have been expanding in recent years, and higher durability has been demanded. Under such circumstances, just improving binders and color developing materials in heat-sensitive recording layers has been unable to solve the aforementioned problems.

Proposals to solve the above problems include formation of a protective layer on the heat-sensitive recording material (Patent Documents 1, 2 and 3). By providing a protective layer on the heat-sensitive recording material, the recording layer and recorded image achieve higher durability.

Patent Documents 1 and 2 disclose heat-sensitive paper materials that show sufficient durability without the use of a crosslinking agent. However, these materials do not always have water resistance enough to achieve antiblocking properties in water-wetted state that are addressed in the present invention. Moreover, because of the fact that the protective resin has a low minimum film-forming temperature, the resin shows a tendency to aggregate by forming a film during storage (insufficient storage stability), causing bad productivity. Further, the resin is so soft that the film thereof has low strength. Furthermore, the films often show a blocking tendency.

Patent Document 3 discloses a heat-sensitive recording material in which a protective layer contains fine particles based on polymethyl methacrylate. However, the patent document does not describe SP values and Tg, and does not describe sufficient water resistance that is an object of the present invention.

Patent Document 1: JP-A-2004-74531
Patent Document 2: WO 2004/016440 A1
Patent Document 3: JP-A-H5-185726

DISCLOSURE OF THE INVENTION

Problems to be Solved by the Invention

It is an object of the present invention to provide emulsions for heat-sensitive recording materials that provide high durability, in particular antiblocking properties in water-wetted state and chemical resistance, and have significantly improved storage stability.

Means for Solving the Problems

The present inventors diligently studied in order to solve the above problems. They have then found that the problems are solved by providing, on a heat-sensitive recording medium, a layer based on a resin emulsion with a specific composition, constitution and properties. The present invention has been completed based on the finding.

[1] A heat-sensitive recording material according to the present invention comprises a heat-sensitive recording layer on a support which layer produces a color upon heating, and a protective layer on the heat-sensitive recording layer, the protective layer being obtained from a composition (A) comprising an emulsion of a copolymer resin (a) that is a main component, (1) the copolymer resin (a) comprising a vinyl monomer component having a carboxyl group, and a vinyl monomer component copolymerizable with the vinyl monomer component, (2) the copolymer resin (a) including 1 to 10 parts by weight of the vinyl monomer component having a carboxyl group based on 100 parts by weight of the copolymer resin, (3) the copolymer resin (a) having a SP value (solubility parameter) of not less than 9.5 $(cal/cm^3)^{1/2}$ and a glass transition temperature (Tg) of 20 to 130° C., (4) the emulsion of the copolymer resin (a) having a minimum film-forming temperature (MFT) of more than 5° C. to less than 50° C.

[2] In the heat-sensitive recording material described in [1], the copolymer resin (a) may have a SP value of 9.5 to 13.0 $(cal/cm^3)^{1/2}$.

[3] In the heat-sensitive recording material described in [1], the copolymer resin (a) may contain methyl methacrylate as copolymerizable vinyl monomer component and may have a SP value of 9.5 to 11.0 $(cal/cm^3)^{1/2}$.

[4] In the heat-sensitive recording material described in [3], the copolymer resin (a) may have Tg of 20 to 80° C.

[5] In the heat-sensitive recording material described in [1], the copolymer resin (a) may contain (meth)acrylonitrile as copolymerizable component and may have a SP value of not less than 10.8 $(cal/cm^3)^{1/2}$.

[6] In the heat-sensitive recording material described in [5], the copolymer resin (a) may have Tg of 30 to 130° C.

[7] In the heat-sensitive recording material described in [1], the protective layer may be obtained from the composition (A) comprising the emulsion of the copolymer resin (a) that is a main component, in combination with an emulsion of a polyolefin copolymer resin (b) that comprises a single or two or more α-olefins having 2 to 16 carbon atoms, and the weight ratio of solid content of the polyolefin copolymer resin (b) to 100 parts by weight of the copolymer resin (a) may be 0.5 to 10 parts by weight.

Advantages of the Invention

A heat-sensitive recording material according to the present invention has a heat-sensitive recording layer on a support which layer produces a color when heated, and a protective layer on the heat-sensitive recording layer. The protective layer is obtained from a composition (A) comprising an emulsion of a copolymer resin (a) that is a main component. The copolymer resin (a) includes a vinyl monomer component having a carboxyl group, and a vinyl monomer component copolymerizable with the vinyl monomer component. The copolymer resin (a) contains 1 to 10 parts by weight of the vinyl monomer component having a carboxyl group. The copolymer resin (a) has a SP value (solubility parameter) of not less than 9.5 $(cal/cm^3)^{1/2}$ and a glass transition temperature (Tg) of 20 to 130° C. The emulsion of the copolymer resin (a) has a minimum film-forming temperature (MFT) of more than 5° C. The emulsion for heat-sensitive recording material provides high durability, in particular water resistance, antiblocking properties in water-wetted state and chemical resistance, and has superior storage stability.

PREFERRED EMBODIMENTS OF THE INVENTION

Hereinbelow, the heat-sensitive recording materials according to the present invention will be described in detail. In the invention, the solubility parameter (SP value/unit: $(cal/cm^3)^{1/2}$) and the glass transition temperature (Tg/unit: (° C.)) are calculated with calculation software CHEOPS (version 4.0) manufactured by Million Zillion Software Inc. The calculation technique used in the calculation software is described in Computational Materials Science of Polymers, Chapter XII (A. A. Askadskii, Cambridge Intl Science Pub (2005/12/30)). The minimum film-forming temperature (MFT/unit: ° C.) is measured in accordance with JIS K 6828-2.

The copolymer resin (a) includes a vinyl monomer component having a carboxyl group, and a vinyl monomer component copolymerizable with the vinyl monomer component. The carboxyl group-containing vinyl monomer in the copolymer resin is essential in order to ensure polymerization stability when the emulsion of the copolymer resin is prepared. Further, by neutralizing the copolymer with a base after the polymerization, the resin particles are hydrated and are swollen and softened to provide high film-forming properties. Furthermore, the carboxyvinyl monomer functions to increase dispersibility and binding properties of optionally used fillers. Moreover, it provides a reactive group for reaction with an optionally used crosslinking agent.

The copolymer resin (a) preferably includes 1 to 10 parts by weight, more preferably 2 to 8 parts by weight of the carboxyl group-containing vinyl monomer based on 100 parts by weight of the copolymer resin. When the amount is less than 1 part by weight, the polymerization stability will be poor, and the resin particles will not be swollen and softened sufficiently by the neutralization and film-forming properties will be deteriorated. When the amount exceeds 10 parts by weight, the protective layer will not have sufficient water resistance, and the resin particles will be dissolved during the neutralization to cause gelation.

Examples of the carboxyl group-containing vinyl monomers include ethylenically unsaturated monobasic carboxylic acids such as acrylic acid, methacrylic acid and crotonic acid; ethylenically unsaturated dibasic carboxylic acids such as itaconic acid, maleic acid and fumaric acid; and monoalkyl esters of these acids. These monomers may be used singly or two or more kinds may be used in combination.

The copolymer resin (a) should have a solubility parameter (SP value) of not less than 9.5 $(cal/cm^3)^{1/2}$, preferably in the range of 9.5 to 13.0 $(cal/cm^3)^{1/2}$. When the parameter exceeds 13.0 $(cal/cm^3)^{1/2}$, the copolymer resin emulsion has so high hydrophilicity that good water resistance is not obtained, and the product-ion of the emulsion of the copolymer resin (a) is often difficult. When the parameter is less than 9.5 $(cal/cm^3)^{1/2}$, the obtainable layer will not be solid and will not show sufficient adhesion with the heat-sensitive recording medium and will separate therefrom.

The copolymer resin (a) preferably has a glass transition temperature (Tg) of 20 to 130° C., more preferably 25 to 125° C. When the glass transition temperature is less than 20° C., the heat resistance will be poor. When it exceeds 130° C., film-forming properties will be inferior.

The minimum film-forming temperature (MFT) of the emulsion of the copolymer resin (a) may be controlled by changing the composition of resin or the Tg of resin, or by heating the resin particles under alkaline conditions to swell and soften the particles. Even resins having an identical composition and an identical Tg show different MFT when the degree of neutralization is different. The MFT is more than 5° C., preferably from 5 to 50° C. When the minimum film-forming temperature is 5° C. or below, the surface of the resin that is stored may form a film during storage because of low storage stability, and bad workability is caused in the formation of the protective layer. Further, the resin particles with such a low minimum film-forming temperature are excessively swollen and softened, and the resin emulsion can increase the viscosity and can be gelled with storage time. Furthermore, a film from such soft resin has low strength and will not permit stable running in the thermal printing. When the minimum film-forming temperature is 50° C. or above, film-forming properties are insufficient, and the obtainable protective layer can have defects or fine cracks.

As described above, the MFT is an important indicator of polymer properties. The MFT is an indicator related to (1) the glass transition temperature of the copolymer resin, (2) the SP value of the copolymer resin, (3) the acid content in the copolymer resin, (4) the degree of neutralization (the base content relative to the acid content in the copolymer resin), (5) the pH of the emulsion, and (6) temperature conditions (heating conditions) for the emulsion during or after the neutralization.

Examples of the vinyl monomer components copolymerizable with the carboxyl group-containing vinyl monomer components in the copolymer resin (a) emulsion include: methyl methacrylate and (meth)acrylonitrile described later; alkyl (meth)acrylates such as methyl acrylate and ethyl (meth)acrylate; aromatic vinyl monomers such as styrene and α-methylstyrene; functional group-containing vinyl monomers such as amide group-containing vinyl monomers such as (meth)acrylamide, hydroxyl group-containing vinyl monomers such as 2-hydroxyethyl (meth)acrylate, glycidyl group-containing vinyl monomers such as glycidyl (meth) acrylate, amino group-containing vinyl monomers such as N,N-dimethylaminoethyl (meth)acrylate, acetoacetoxy group-containing vinyl monomers such as acetoacetoxyethyl (meth)acrylate, phosphoric group-containing monomers such as 2-methacryloyloxyethyl acid phosphate, and sulfonate-containing monomers such as styrenesulfonates; vinyl esters such as vinyl acetate and vinyl propionate; N-substituted unsaturated carboxamides such as N-methylol (meth) acrylamide; heterocyclic vinyl compounds such as vinylpyrrolidone; vinylidene halide compounds such as vinylidene chloride and vinylidene fluoride; α-olefins such as ethylene and propylene; and dienes such as butadiene. These may be used singly or two or more kinds may be used in combination. Examples of the copolymerizable vinyl monomers further include cyano group-containing vinyl monomers belonging to (meth)acrylonitriles. A crosslinkable vinyl monomer may be used as required, and examples of such monomers include methylenebis(meth)acrylamide, divinyl benzene, and polyethylene glycol chain-containing di(meth)acrylate. The crosslinkable vinyl monomer may contain two or more vinyl groups.

The use of methyl methacrylate as the vinyl monomer component copolymerizable with the carboxyl group-containing vinyl monomer component in the copolymer resin (a) provides increased water resistance, in particular antiblocking properties in water-wetted state. In the copolymer resin (a), the amount of methyl methacrylate based on 100 parts by weight of the copolymer resin (a) is not particularly limited while still achieving the object of the invention, and is preferably in the range of 15 to 90 parts by weight, more preferably 20 to 80 parts by weight. When the amount of methyl methacrylate is not in this range, the water resistance and film-forming properties may not be balanced.

When the vinyl monomer components for the copolymer resin (a) include methyl methacrylate as an essential component, the solubility parameter (SP value) of the copolymer resin (a) is suitably in the range of 9.5 to 11.0 $(cal/cm^3)^{1/2}$, whereby the water resistance, in particular antiblocking properties in water-wetted state can be markedly increased. When the parameter exceeds 11.0 $(cal/cm^3)^{1/2}$, the copolymer resin emulsion has so high hydrophilicity that good antiblocking properties in water-wetted state are not obtained. When the vinyl monomer components for the copolymer resin (a) include methyl methacrylate as an essential component and when the SP value of the copolymer resin (a) is less than 9.5 $(cal/cm^3)^{1/2}$, the obtainable layer will not be solid and will not show sufficient adhesion with the heat-sensitive recording medium and will separate therefrom. In the above case, the glass transition temperature (Tg) is preferably in the range of 20 to 80° C., more preferably 25 to 75° C. When the glass transition temperature is less than 20° C., the heat resistance will be poor. When it exceeds 80° C., film-forming properties will be inferior. When the copolymer resin (a) contains methyl methacrylate as a main component and when the solubility parameter (SP value) is in the range of 9.5 to 11.0 $(cal/cm^3)^{1/2}$ it is preferable in view of MFT that the emulsion of the copolymer resin is pH adjusted to not less than 8.0, more preferably to a pH of 9.0 by neutralization with a base.

The use of (meth)acrylonitrile as the vinyl monomer component copolymerizable with the carboxyl group-containing vinyl monomer component in the copolymer resin (a) provides increased chemical resistance, for example resistance to plasticizers, oils, fats and solvents. In the copolymer resin (a), the amount of (meth)acrylonitrile based on 100 parts by weight of the copolymer resin (a) is not particularly limited while still achieving the object of the invention, and is preferably in the range of 15 to 80 parts by weight. When the amount of (meth)acrylonitrile is not in this range, the chemical resistance and film-forming properties may not be balanced. When methyl methacrylate and (meth)acrylonitrile are used in combination as the vinyl monomer components copolymerizable with the carboxyl group-containing vinyl monomer component in the copolymer resin (a), the amount of (meth)acrylonitrile is preferably in the range of 15 to 20 parts by weight based on 100 parts by weight of the copolymer resin (a).

When methyl methacrylate is not used and (meth)acrylonitrile is used as a main vinyl monomer component copolymerizable with the carboxyl group-containing vinyl monomer component in the copolymer resin (a), the solubility parameter (SP value) is suitably not less than 10.8 $(cal/cm^3)^{1/2}$, whereby the chemical resistance, for example resistance to plasticizers, oils, fats, and solvents, can be markedly increased. When the parameter is less than 10.8 $(cal/cm^3)^{1/2}$, plasticizers and organic solvents may permeate the protective layer (through the molecules of resin) to reach the heat-sensitive layer, and the chemical resistance can be deteriorated to cause undesired coloration or discoloration. In the above case, the glass transition temperature (Tg) is preferably in the range of 30 to 130° C. When the glass transition temperature is less than 30° C., the heat resistance will be poor. When it exceeds 130° C., film-forming properties will be inferior. When methyl methacrylate is not used and (meth) acrylonitrile is used as the vinyl monomer component copolymerizable with the carboxyl group-containing vinyl monomer component in the copolymer resin (a) and when the solubility parameter (SP value) is not less than 10.8 $(cal/cm^3)^{1/2}$, it is preferable in view of MFT that the emulsion is pH adjusted to less than 8 when it is neutralized with a base.

When methyl methacrylate and/or (meth)acrylonitrile is used as the vinyl monomer component copolymerizable with the carboxyl group-containing vinyl monomer component in the copolymer resin (a), the copolymerizable vinyl monomer components described above may be used in combination therewith as long as the obtainable copolymer resin (a) has the aforesaid solubility parameter (SP value) and glass transition temperature (Tg).

The (number) average particle diameter of the copolymer resin emulsion in the present invention is not particularly limited, and is preferably in the range of 50 to 500 nm, more preferably 70 to 300 nm. Excessively small average particle diameter often results in too high a viscosity of the emulsion. In such cases, the resin concentration in the production has to be low, and the coating liquid to form the protective layer does not dry quickly, which causes economic disadvantages such as deteriorated productivity of the heat-sensitive recording materials. When the average particle diameter is too large, the obtainable protective layer will not be dense and may fail to keep the heat-sensitive recording layer intact. The particle diameters may be controlled to the above-mentioned range by altering the composition of the copolymer resin (a) emulsion and by the use of a surfactant.

The weight-average molecular weight of the copolymer resin (a) in the emulsion is not particularly limited, and is preferably in the range of 10,000 to 2,000,000, more preferably 50,000 to 1,000,000. Excessively low molecular weight can lead to low strength of the protective layer. Excessively high molecular weight increases the probability of problems such as high viscosity and low film-forming properties.

The production of the emulsion of the copolymer resin (a) may involve an emulsifier as required to obtain stability. Examples of the emulsifiers include anionic surfactants such as sulfates of higher alcohols, alkylbenzenesulfonates, aliphatic sulfonates and alkyldiphenyl ether sulfonates; and nonionic surfactants such as alkyl esters of polyethylene glycols, alkylphenyl ethers of polyethylene glycols and alkyl ethers of polyethylene glycols. These may be used singly or two or more kinds may be used in combination. The amount of the emulsifier is not particularly limited but is preferably minimal in view of water resistance of the resin.

The production of the copolymer resin (a) emulsion may use a polymerization initiator. Examples thereof include water-soluble initiators such as persulfates, hydrogen peroxide, organic hydroperoxides and azobiscyanovaleric acid; oil-soluble initiators such as azobisisobutyronitrile and benzoyl peroxide; and redox initiators that are combinations of the above initiators and reducing agents. The amount of the polymerization initiator is not particularly limited and may be determined according to the conventional art. For example, the initiator may be used in an amount of 0.1 to 10 parts by weight, preferably 0.1 to 5 parts by weight relative to 100 parts by weight of the vinyl monomers.

The production of the copolymer resin (a) emulsion may involve a molecular weight modifier (chain transfer agent) as required. Examples thereof include mercaptans such as octylmercaptan, n-dodecylmercaptan and t-dodecylmercaptan; low-molecular weight halides; 1-thioglycerol, α-methylstyrene dimers and methallylsulfonates.

The emulsion of the copolymer resin (a) is neutralized with a base. The neutralizer used herein may be (aqueous) ammonia. Sodium hydroxide, potassium hydroxide and amines may be used as the neutralizers, but the use thereof can lower the water resistance of the protective layer, damage the thermal head, or reduce the heat-sensitivity in the thermal printing. (Aqueous) ammonia is free of such negative effects. Furthermore, because it is easily eliminated at relatively low temperatures, the water resistance can be developed in a short time after the formation of the protective layer. In view of dispersing stability, the pH of the emulsion is preferably adjusted to 7 or above. According to the finding by the present inventors, when the copolymer resin (a) has a low Tg or a high SP value, the advantages of the present invention are achieved by controlling the pH of the copolymer resin emulsion to a low level but not less than 7, and by controlling the MFT to above 5° C.

Although the protective layer based on the copolymer resin (a) has sufficient heat resistance required for heat-sensitive recording materials, it can achieve far improved properties such as running stability in thermal printing, anti-sticking properties and heat resistance by containing a polyolefin copolymer resin (b). The polyolefin copolymer resin (b) comprises a single or two or more α-olefins having 2 to 16 carbon atoms, and at least one such copolymer resin may be used in the invention. The polyolefin copolymer resin functions to drastically improve running stability, anti-sticking properties and heat resistance that are required for the protective layer. Examples of the polyolefin copolymer resins include homopolymers and copolymers of two or more α-olefins such as ethylene, propylene, 1-butene, 3-methyl-1-butene, 4-methyl-1-pentene, 3-methyl-1-pentene, 1-heptene, 1-hexene, 1-octene, 1-decene and 1-dodecene. In particular, ethylene, propylene and 1-butene are preferable.

The particle diameter of the polyolefin copolymer resin (b) in the emulsion is not particularly limited but is preferably small. For example, the particle diameter may be 2000 nm or less, more preferably 1000 nm or less. With large diameters, the particles may form a separate upper layer in the emulsion containing the copolymer resin (a) or may not be dispersed homogeneously in the emulsion. As a result, the protective layer may be inhomogeneous or may not show stable properties. With the particle diameters being not more than 1000 nm, the particles can exist in the system stably, homogeneously and independently. The molecular weight of the polyolefin copolymer resin (b) is not particularly limited, and is preferably not more than 10,000. When the molecular weight is too high, the resin may fail to improve running stability in thermal printing, anti-sticking properties and heat resistance.

The solid weight ratio of the polyolefin copolymer resin (b) to 100 parts by weight of the solid in the resin (a) emulsion is in the range of 10 to 0.5 parts by weight, preferably 10 to 1 parts by weight, more preferably 10 to 3 parts by weight. At more than 10 parts by weight, the film-forming properties may be deteriorated and the obtainable protective layer may have defects. In addition, an ink printed on the protective layer may not adhere adequately. At less than 0.5 part by weight, running stability and heat resistance (thermal stability) may not be improved.

Known copolymer resins may be used in addition to the copolymer resin (a) and the polyolefin copolymer resin (b) to constitute the heat-sensitive recording material, while still achieving the advantages of the present invention.

In the present invention, the layer based on the copolymer resin (a) may contain a filler as required. The amount thereof is not particularly limited, and the kind and amount of the filler may be appropriately selected while still achieving the advantages of the present invention. Examples of the fillers include inorganic fillers such as calcium carbonate, magnesium carbonate, kaolin, talc, clay, aluminum hydroxide, barium sulfate, silicon oxide, titanium oxide, zinc oxide and colloidal silica; and organic fine particles such as urea-formalin resin and polystyrene fine particles. These may be used singly or two or more kinds may be used in combination.

Examples of the optional components other than the fillers include lubricants such as metal salts of higher fatty acids and higher fatty acid amides for improving running stability; ultraviolet absorbents, antioxidants, anti-foaming agents, wetting agents, viscosity modifiers, and other auxiliaries and additives.

A crosslinking agent is not compulsory in the invention but may be used appropriately without limitation as long as the advantages of the invention are achieved. The crosslinking agent should be appropriately selected from materials capable of reacting with the carboxyl groups in the copolymer resin (a) and various functional groups derived from the copolymerizable vinyl monomers (e.g., hydroxyl groups, methylol groups, amino groups, acetoacetyl groups, glycidyl groups). Examples include glyoxal, dimethylol urea, glycidyl ethers of polyhydric alcohols, ketene dimer, dialdehyde starch, polyamideamine-epichlorohydrin, ammonium zirconium carbonate, aluminum sulfate, calcium chloride and boric acid.

Further, other well-known aqueous resins may be used in combination with the copolymer resin (a) to constitute the layer based on the copolymer resin (a). Examples of the resins include natural resins (such as sodium alginate, starch, casein and celluloses) and synthetic resins (such as polyvinyl alcohols, synthetic rubber latexes, polyurethanes, epoxies, vinyl chloride and vinylidene chloride). Of these, modified products of polyvinyl alcohols are preferred, and examples thereof include but are not limited to carboxyl-modified polyvinyl alcohols, epoxy-modified polyvinyl alcohols, silanol-modified polyvinyl alcohols, acetoacetyl-modified polyvinyl alcohols, amino-modified polyvinyl alcohols, olefin-modified polyvinyl alcohols, amide-modified polyvinyl alcohols and nitrile-modified polyvinyl alcohols.

The color-developing system of the heat-sensitive recording layer according to the present invention is not particularly limited. Examples of the color-developing system include a system utilizing a leuco dye and an acidic substance represented by a phenolic substance; a system utilizing an imino compound and an isocyanate compound; and a system utilizing a diazo compound and a coupler.

The layer from the composition (A) that is based on the emulsion of the copolymer resin (a) may be formed as described below to achieve the object of the present invention. The composition (A) may be applied on a known heat-sensitive recording layer that is normally provided on a paper, a synthetic paper, a film, etc. as a support, and/or may be applied on the back of the support, or between the support and the heat-sensitive recording layer, in an amount of 1 to 10 $g/m^2$ in terms of dry weight, with use of an air knife coater, a gravure coater, a rod coater, or the like. The emulsion of the copolymer resin (a) may be appropriately used to form parts where functions such as water resistance and heat resistance are required, for example heat-sensitive recording layers, similarly to the protective layer.

EXAMPLES

The present invention will be described in detail by Examples without limiting the scope of the invention. In Examples, parts and % refer to parts by weight and % by weight unless otherwise specified.

Production Example a-1

A separable flask equipped with a stirrer and a reflux condenser was charged with 367 parts of deionized water and 0.3 part of sodium dodecylbenzenesulfonate. The flask was then purged with nitrogen gas and the temperature was increased to 70° C. Thereafter, 1 part of potassium persulfate was added, and an emulsion of vinyl monomers having the following composition was continuously added over a period of about 4 hours. The temperature was then increased to 80° C. and maintained constant for 2 hours, whereby the polymerization was completed. After the completion of the polymerization, aqueous ammonia was added to render the liquid alkaline. The temperature was maintained constant for another hour to carry out hydration and swelling/softening treatments, and the liquid was cooled to room temperature. As a result, a copolymer resin emulsion (a-1) was obtained which had a pH adjusted to about 9.0 and a solid content of about 20%.

Composition of Vinyl Monomer Emulsion:

| | |
|---|---|
| Methyl methacrylate | 31 parts |
| Acrylonitrile | 18 parts |
| Butyl methacrylate | 39 parts |
| Methacrylic acid | 7 parts |
| Acrylamide | 5 parts |
| Deionized water | 40 parts |
| Sodium dodecylbenzenesulfonate | 0.5 part |

Production Examples a-2 to a-8, and Comparative Production Examples a-9 to a-16)

Copolymer resin (a) emulsions (a-2) to (a-8) and comparative emulsions (a-9) to (a-16) were prepared in the same manner as Production Example (a-1), except that the composition of vinyl monomers and/or the pH was changed. The emulsions (a-2) to (a-6) were adjusted to pH 9, and the emulsions (a-7) and (a-8) were adjusted to pH 7.5. The emulsions (a-9) to (a-11) were adjusted to pH 9, the emulsions (a-14) and (a-16) were adjusted to pH 8, and the emulsion (a-15) was adjusted to pH 7.

Table 1 sets forth the compositions, polymerization results, MFT and storage stability of the emulsions from Production Examples and Comparative Production Examples.

The solubility parameter (SP value), glass transition temperature, MFT, production stability and storage stability were evaluated as follows.

(Solubility Parameter and Glass Transition Temperature)

The solubility parameter (SP value/unit: $(cal/cm^3)^{1/2}$) and the glass transition temperature (Tg/unit: (° C.)) were calculated with calculation software CHEOPS (version 4.0) manufactured by Million Zillion Software Inc.

(MFT)

The MFT (minimum film-forming temperature) of the resin was measured in accordance with JIS K 6828-2.

(Production Stability)

The production stability was evaluated by visually inspecting for aggregates during the production.

AA: The emulsion was stable with a milky white appearance.

The particles did not aggregate during production or did not adhere to the stirring blade. There were no residues.

BB: Some particles aggregated during production and adhered to the stirring blade.

CC: The emulsion polymerization did not take plate, or the particles aggregated and caused gelation.

TABLE 1

Production Examples and Comparative Production Examples

| | Production Example | | | | | | | |
|---|---|---|---|---|---|---|---|---|
| | a-1 | a-2 | a-3 | a-4 | a-5 | a-6 | a-7 | a-8 |
| MMA | 31 | 24 | 49 | 77 | 30 | 28 | | |
| ST | | 55 | 5 | 2 | 10 | | | |
| AN | 18 | | | | | 15 | 45 | 65 |
| BMA | 39 | 3 | | | | 6 | | |
| BA | | 10 | 27 | 9 | | | 40 | 20 |
| MA | | | 10 | | 44 | 27 | | |
| HEMA | | | | 7 | | 8 | 5 | 5 |
| MAc | 7 | 6 | 2 | 5 | 8 | 6 | 5 | 5 |
| AAM | 5 | 2 | 5 | | 8 | | | |
| MAm | | | 2 | | | 10 | 5 | 5 |
| nDM | | | | 0.5 | | | 0.5 | |
| pH | 9 | 9 | 9 | 9 | 9 | 9 | 7.5 | 7.5 |
| Production stability | AA | AA | AA | AA | AA | AA | AA | AA |
| SP value | 10.26 | 9.53 | 9.77 | 9.67 | 10.31 | 10.75 | 10.99 | 11.43 |
| Tg | 44 | 61 | 27 | 71 | 35 | 45 | 65 | 104 |
| MFT | 10 | 18 | 25 | 25 | 7 | 13 | 17 | 30 |

| | Comparative Production Example | | | | | | | |
|---|---|---|---|---|---|---|---|---|
| | a-9 | a-10 | a-11 | a-12 | a-13 | a-14 | a-15 | a-16 |
| MMA | 5 | 44 | | | | | 31 | |
| ST | 25 | | | | | | | |
| AN | | 12 | 75 | 45 | 45 | 30 | 18 | 65 |
| BMA | 64 | | | | | | 39 | |
| BA | | 20 | 10 | 45 | 30 | 40 | | 30 |
| MA | | | | | | | | |
| HEMA | | 5 | 5 | 5 | 5 | 20 | | |
| MAc | 6 | 15 | 5 | | 15 | 10 | 7 | 5 |
| AAM | | 4 | | | | | 5 | |
| MAm | | | 5 | 5 | 5 | | | |
| nDM | | | 0.5 | | | 0.5 | | |
| pH | 9 | 9 | 9 | — | — | 8 | 7 | 8 |
| Production stability | AA | AA | BB | CC | CC | AA | AA | AA |
| SP value | 9.23 | 10.6 | 11.82 | 10.75 | 11.38 | 10.89 | 10.26 | 11.19 |
| Tg | 28 | 45 | 134 | 59 | 79 | 55 | 44 | 89.8 |
| MFT | <5 | <5 | >50 | — | — | <5 | >50 | <5 |

(MMA: methyl methacrylate, ST: styrene, AN: acrylonitrile, BMA: n-butyl methacrylate, BA: n-butyl acrylate, MA: methyl acrylate, HEMA: 2-hydroxyethyl methacrylate, MAc: methacrylic acid, AAM: acrylamide, MAm methacrylamide, nDM: n-dodecylmercaptane)

Next, Examples and Comparative Examples will be described wherein heat-sensitive recording materials were produced by forming protective layers from the emulsions of Production Examples (a-1) to (a-8) and Comparative Production Examples (a-9) to (a-12) and (a-14) to (a-16). In Examples and Comparative Examples, the compositions are in terms of parts by weight.

The emulsions (a-12) and (a-13) were not used because of bad production stability. Because the storage stability of the emulsion (a-15) was very bad, the emulsion was used as a comparative example immediately after prepared.

Example 1

100 g of the copolymer resin emulsion (a-1) from Production Example was combined with 2.5 g of a polyolefin copolymer resin emulsion (CHEMIPEARL W4005 manufactured by Mitsui Chemicals, Inc.) having a solid concentration of 40%. They were sufficiently mixed together by stirring. The mixture was applied on commercially available heat-sensitive word-processor paper (TAI-2026-W manufactured by KOKUYO Co., Ltd.) by means of a bar coater such that the dry weight would be 1.6 g/m$^2$. The coating was then dried (force-drying at 50° C. for 60 seconds followed by curing at 40° C. for 24 hours). A heat-sensitive recording material was thus obtained.

Example 2

A heat-sensitive recording material was obtained in the same manner as Example 1, except that the copolymer resin emulsion (a-2) from Production Example was used, that the 40%-solid polyolefin copolymer resin emulsion (CHEMIPEARL W4005 manufactured by Mitsui Chemicals, Inc.) was not used, and that 3.3 g of 30% epoxy polyamide resin (EURAMINE P-5600 manufactured by Mitsui Chemicals, Inc.) was added as a crosslinking agent.

Example 3

A heat-sensitive recording material was obtained in the same manner as Example 1, except that the copolymer resin emulsion (a-3) from Production Example was used, that 1.5 g of a 40%-solid polyolefin copolymer resin emulsion (CHEMIPEARL WF640 manufactured by Mitsui Chemicals, Inc.) was used, and that 5 g of 20% ammonium zirconium carbonate (BAYCOAT 20 manufactured by Nippon Light Metal Co., Ltd.) was added as a crosslinking agent.

Example 4

The copolymer resin emulsion (a-4) from Production Example was applied on commercially available heat-sensitive word-processor paper (TAI-2026-W manufactured by KOKUYO Co., Ltd.) by means of a bar coater such that the dry weight would be 1.6 g/m$^2$. The coating was then dried (force-drying at 50° C. for 60 seconds followed by curing at 40° C. for 24 hours). A heat-sensitive recording material was thus obtained.

Example 5

A heat-sensitive recording material was obtained in the same manner as Example 1, except that the copolymer resin emulsion (a-5) from Production Example was used, that 0.5 g of a 40%-solid polyolefin copolymer resin emulsion (CHEMIPEARL W950 manufactured by Mitsui Chemicals, Inc.) was used, and that 2 g of glycidyl ether of polyhydric alcohol (DENACOL EX-512 manufactured by Nagase ChemteX Corporation) was added as a crosslinking agent.

Example 6

A heat-sensitive recording material was obtained in the same manner as Example 1, except that the copolymer resin emulsion (a-6) from Production Example was used, that 3.0 g of a 40%-solid polyolefin copolymer resin emulsion (CHEMIPEARL W401 manufactured by Mitsui Chemicals, Inc.) was used, and that 1 g of a polyfunctional aziridine compound (CHEMITITE PZ-33 manufactured by NIPPON SHOKUBAI CO., LTD.) was added as a crosslinking agent.

Example 7

A heat-sensitive recording material was obtained in the same manner as Example 1, except that the copolymer resin emulsion (a-7) from Production Example was used.

Example 8

A heat-sensitive recording material was obtained in the same manner as Example 1, except that the copolymer resin emulsion (a-8) from Production Example was used, and that 2.5 g of a 40%-solid polyolefin copolymer resin emulsion (CHEMIPEARL W400 manufactured by Mitsui Chemicals, Inc.) was used.

Example 9

A heat-sensitive recording material was obtained in the same manner as Example 1, except that the 40%-solid polyolefin copolymer resin emulsion (CHEMIPEARL W4005 manufactured by Mitsui Chemicals, Inc.) was not used.

Comparative Example 1

A heat-sensitive recording material was obtained in the same manner as Example 1, except that the copolymer resin emulsion (a-9) from Production Example was used, and that the 40%-solid polyolefin copolymer resin emulsion (CHEMIPEARL W4005 manufactured by Mitsui Chemicals, Inc.) was used in an amount of 0.3 g.

Comparative Example 2

A heat-sensitive recording material was obtained in the same manner as Example 1, except that the copolymer resin emulsion (a-10) from Production Example was used, that 1.4 g of a 40%-solid polyolefin copolymer resin emulsion (CHEMIPEARL W410 manufactured by Mitsui Chemicals, Inc.) was used, and that 3.3 g of 30% epoxy polyamide resin (EURAMINE P-5600 manufactured by Mitsui Chemicals, Inc.) was added as a crosslinking agent.

Comparative Example 3

A heat-sensitive recording material was obtained in the same manner as Example 1, except that the copolymer resin emulsion (a-11) from Production Example was used, and that 0.3 g of a 40%-solid polyolefin copolymer resin emulsion (CHEMIPEARL W400 manufactured by Mitsui Chemicals, Inc.) was used.

Comparative Example 4

A heat-sensitive recording material was obtained in the same manner as Example 1, except that the copolymer resin emulsion (a-14) from Production Example was used, and that the 40%-solid polyolefin copolymer resin emulsion (CHEMIPEARL W4005 manufactured by Mitsui Chemicals, Inc.) was not used.

Comparative Example 5

A heat-sensitive recording material was obtained in the same manner as Example 1, except that the copolymer resin emulsion (a-15) from Production Example was used.

Comparative Example 6

A heat-sensitive recording material was obtained in the same manner as Example 1, except that the copolymer resin emulsion (a-16) from Production Example was used, that the 40%-solid polyolefin copolymer resin emulsion (CHEMIPEARL W4005 manufactured by Mitsui Chemicals, Inc.) was used in an amount of 2.0 g, and that 8 g of a 50% dispersion of fine powder silica (P-527 manufactured by MIZUSAWA KAGAKU) was added as a filler.

The heat-sensitive recording materials from Examples 1 to 9 and Comparative Examples 1 to 6 were evaluated by the following methods. The results are shown in Table 2.

(1) Film-Forming Properties

The copolymer resin emulsion was applied on a glass plate to a thickness of 76 μm by means of an applicator. The coating was dried at room temperature for a day. The condition of the film was visually observed.

AA: Film-forming properties were good.

BB: Although the film was cracked, it had transparency and was practically usable.

CC: The emulsion did not form a film.

(2) Water Resistance

One droplet of water was dropped on the polymer-coated surface of the heat-sensitive recording material. The heat-sensitive recording materials were laminated such that the polymer-coated surfaces were in contact with each other. The laminate was subjected to a load of 100 g/cm$^2$ at 40° C. and 65% RH for at least 24 hours. The materials were then separated from each other to check blocking.

AA: The materials were easily separated without any blocking.

BB: Although slight resistance was felt, the materials were separated without problems and the polymer-coated surfaces were free of defects.

CC: Small resistance was felt when the materials were separated, and the polymer-coated surfaces had scattered scratches that appeared to be defects.

DD: The resistance was so strong that the materials were not separated smoothly. The polymer-coated surfaces had severe damages.

(3) Plasticizer Resistance

A solidly shaded pattern image was printed on the heat-sensitive recording material with a thermal printer (TH-PMD manufactured by Ohkura Electric Co., Ltd.) under the following conditions. A transparent electric-insulating polyvinyl chloride adhesive tape (product of NITTO DENKO CORPORATION) was applied to the image. The material was allowed to stand at 40° C. for 24 hours, and then the tape was removed. The density was compared between areas where the tape had or had not been applied.

Applied voltage: 24 V

Pulse width: 1.74 ms

Applied energy: 0.34 mj/dot

AA: The print density was not reduced.

BB: The density was reduced in very limited areas, but the overall appearance did not change.

CC: The overall print density was slightly reduced, but no problems would be caused in practical use.

DD: The print disappeared.

(4) Running Stability

A solid black pattern image was printed under the same conditions as in (3) using the thermal printer (TH-PMD manufactured by Ohkura Electric Co., Ltd.). The printing was observed.

AA: The printing noise was small, and no contamination adhered to the printhead after the printing.

BB: Although the printing noise was relatively big, no contamination adhered to the printhead and there was no problem in practical use.

CC: Contamination adhered to the printhead, and the protective layer was partly removed from the printed surface.

(5) Storage Stability

The resin emulsion was stored at 40° C. for 7 days to determine the storage stability by visual observation of the emulsion.

AA: Properties were unchanged before and after the storage.

BB: The resin had formed a film (foreign matter) on the liquid surface or on the container wall.

CC: The viscosity of the whole emulsion had increased and the emulsion had gelled.

TABLE 2

| | Ex. 1 | Ex. 2 | Ex. 3 | Ex. 4 | Ex. 5 | Ex. 6 | Ex. 7 | Ex. 8 | Ex. 9 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|---|---|---|---|---|---|---|
| Film-forming properties | AA | AA | AA | AA | AA | AA | AA | BB | AA | AA | AA | CC | AA | CC | AA |
| Water resistance | AA | AA | AA | AA | AA | AA | CC | CC | AA | DD | DD | DD | CC | DD | BB |
| Plasticizer resistance | BB | CC | CC | CC | CC | BB | AA | AA | BB | DD | DD | DD | AA | DD | BB |
| Running stability | AA | BB | AA | AA | BB | AA | AA | AA | BB | CC | AA | BB | CC | AA | AA |
| Storage stability | AA | AA | AA | AA | AA | AA | AA | AA | AA | BB | BB | AA | CC | AA | CC |

The invention claimed is:

1. A material, which is a heat-sensitive recording material comprising in this order a support a heat-sensitive recording layer producing a color upon heating, and a protective layer obtained from a composition (A) comprising an emulsion of, as a main component a copolymer resin (a), which copolymer resin (a)

(1) comprises 1-10 wt. %, based on the copolymer resin (a), of a vinyl monomer component (i) having a carboxyl group, methyl methacrylate, and a vinyl monomer component (ii) copolymerizable with (i), and (2) has a SP value (solubility parameter) of 9.5 to 11.0 (cal/cm$^3$)$^{1/2}$ and a glass transition temperature (Tg) of 20 to 130° C., wherein the emulsion of the copolymer resin (a) having a minimum film-forming temperature (MFT) of more than 5° C. to less than 50° C.

2. A material, which is a heat-sensitive recording material comprising in this order a support a heat-sensitive recording layer producing a color upon heating, and a protective layer obtained from a composition (A) comprising an emulsion of, as a main component a copolymer resin (a), which copolymer resin (a)

(1) comprises 1-10 wt.- %, based on the copolymer resin (a), of a vinyl monomer component (i) having a carboxyl group, a (meth)acrylonitrile, and a vinyl monomer component (ii) copolymerizable with (i), and (2) has a SP value (solubility parameter) of not less than 10.8 $(cal/cm^3)^{1/2}$ to 13.0 $(cal/cm^3)^{1/2}$ and a glass transition temperature (Tg) of 30 to 130° C., wherein the emulsion of the copolymer resin (a) having a minimum film-forming temperature (MFT) of more than 5° C. to less than 50° C.

3. The heat-sensitive recording material according to claim 1, wherein the copolymer resin (a) has Tg of 20 to 80° C.

4. The heat-sensitive recording material according to claim 1, wherein the composition (A) comprising the emulsion of the copolymer resin (a) that is a main component further comprises an emulsion of a polyolefin copolymer resin (b) that comprises a single or two or more α-olefins having 2 to 16 carbon atoms, and the weight ratio of solid content of the polyolefin copolymer resin (b) to 100 parts by weight of the copolymer resin (a) is 0.5 to 10 parts by weight.

5. The heat-sensitive recording material according to claim 2, wherein the pH of the emulsion is adjusted to 7 or above.

6. The heat-sensitive recording material according to claim 2, wherein the copolymer resin (a) comprises 2-8 wt. % based on the copolymer resin (a) of vinyl monomer component (i) having a carboxyl group.

7. The heat-sensitive recording material according to claim 1 wherein the pH of the emulsion is adjusted to 7 or above.

8. The heat-sensitive recording material according to claim 1, wherein the copolymer resin (a) comprises 2-8 wt. % based on the copolymer resin (a) of vinyl monomer component (i) having a carboxyl group.

* * * * *